United States Patent [19]

Flesher et al.

[11] 4,323,016

[45] Apr. 6, 1982

[54] WAREHOUSE PALLET

[76] Inventors: Richard H. Flesher, 1178 Willits Dr., Corona, Calif. 91720; Lewis E. Massie, 2218 13th St., Olivenhain, Calif. 92024

[21] Appl. No.: 114,840

[22] Filed: Jan. 24, 1980

[51] Int. Cl.[3] ..... B65D 19/30

[52] U.S. Cl. ..... 108/51.1; 108/53.5; 108/54.1

[58] Field of Search ..... 108/51.1–57.1, 108/901, 902; 248/346; 206/386, 596–600

[56] References Cited

U.S. PATENT DOCUMENTS

| | | | |
|---|---|---|---|
| 2,673,700 | 3/1954 | Eberhardt | 108/53.5 |
| 2,836,384 | 5/1958 | Haglind | 108/57.1 |
| 2,868,487 | 1/1959 | Robinson | 108/57.1 |
| 3,981,249 | 9/1976 | Hermann et al. | 108/53.3 X |
| 4,186,667 | 2/1980 | Seabrook | 108/54.1 |

FOREIGN PATENT DOCUMENTS

| | | | |
|---|---|---|---|
| 1050723 | 1/1954 | France | 108/51.1 |
| 1447360 | 6/1966 | France | 108/51.1 |
| 6414618 | 6/1965 | Netherlands | 108/51.1 |
| 806314 | 12/1958 | United Kingdom | 108/53.3 |

*Primary Examiner*—William E. Lyddane

*Attorney, Agent, or Firm*—Kenyon & Kenyon

[57] ABSTRACT

A warehouse pallet for the handling and storage of goods comprises two spaced, horizontal grids made of steel tubing and separated by a pair of spaced vertical runners and a plurality of peripheral stanchions. The runners are judiciously located to provide a convenient guide for the prongs of a fork-lift. Removable lateral extensions increase the load-carrying surface of the pallet. The pallets include sockets welded to the four corners which engage four upright posts whose upper ends are stabilized by spacing connectors and which fit into the sockets of an overlapping pallet, enabling the stacking of an indefinite number of pallets to optimize space utilization.

13 Claims, 16 Drawing Figures

WAREHOUSE PALLET

BACKGROUND OF THE INVENTION

Warehouse pallets, or "skids", used for palletizing stored and shipped merchandise and adapted to accommodate the prongs of a fork-lift, are traditionally and almost universally made sandwiching three spaced longitudinal 2 inches by 4 inches (5 cm×10 cm), runners between a number plane-defining crosswise slats which are nailed to the runners. There have, however, been a number of alternative designs proffered, some of which utilize metallic or metal tubular construction as does the inventor of the instant skid. The following U.S. Pat. Nos. disclose such pallets:

3,981,249
2,544,743
3,748,814
3,851,981
4,112,854
3,701,326
3,227,108

Pertinent to the instant invention, there also exists pallet stacking frames in the form of tubular steel members which rest on the edges of currently used wooden pallets and define a platform spaced several feet above the pallet to support a second pallet.

One of the drawbacks of existing wood pallets is their tendency to break in the middle due to the weight of the palletized merchandise toward the sides of the pallet from the prongs. Additionally, utilization of wood causes an inherent weakness problem compared to the use of structural steel. Although as mentioned above, a number of metallic pallets have been designed, they all suffer from design problems and are either too flimsy for the rugged, frequently abusive manner in which they are handled, or they are too complex and intricate to be economically practical.

SUMMARY OF THE INVENTION

The pallet of the present invention resolves the above-stated design problems in existing pallets and provides a rugged, relatively lightweight pallet utilizing two runners rather than three. The pallet has been tested by an independent laboratory and shown to be capable of supporting 72,000 pounds (32,725 Kg), and by virtue of the careful positioning of the two support runners and spacer stanchions, weight distribution is such that the problem of the parting of the unit along the longitudinal centerline is all but eliminated.

Other features of the pallet include lateral extensions which hook on either side to expand the support surface area, and sockets mounted to each of the rounded corners of the pallet to engage the posts of a specially designed pallet-stacking frame.

DETAILED DESCRIPTION OF THE PREFERRED EMBODIMENTS

Figure 1:
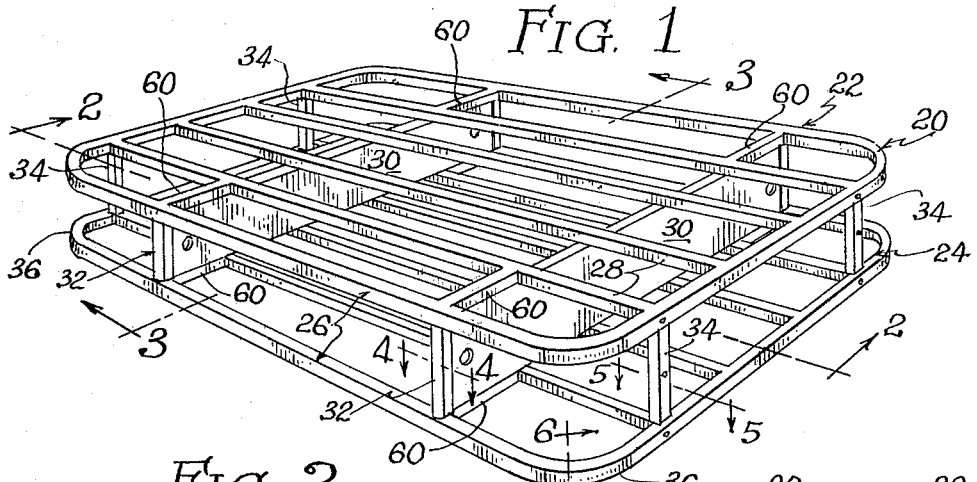
FIG. 1 is a perspective view of the pallet.
Figure 2:
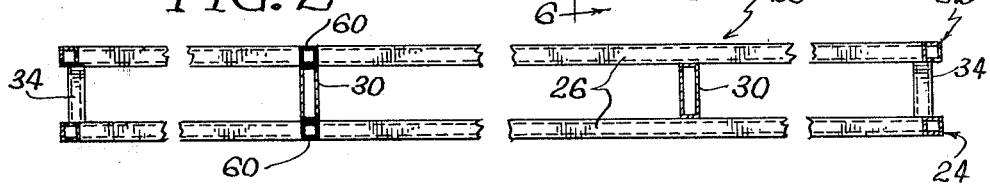
FIG. 2 is a section taken along line 2—2 of FIG. 1.
Figure 3:
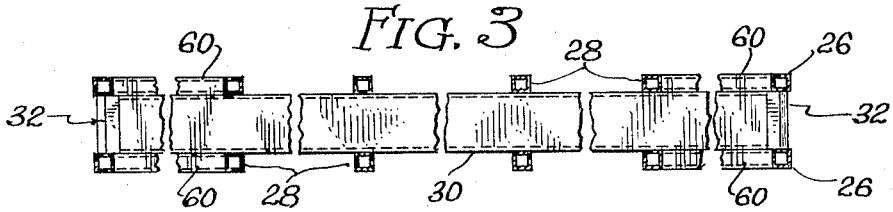
FIG. 3 is a section taken along line 3—3 of FIG. 1.
Figure 4:
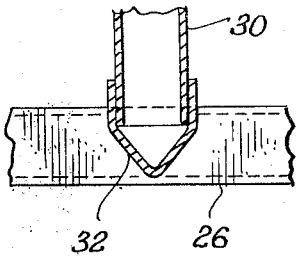
FIG. 4 is a section taken along line 4—4 of FIG. 1.
Figure 5:
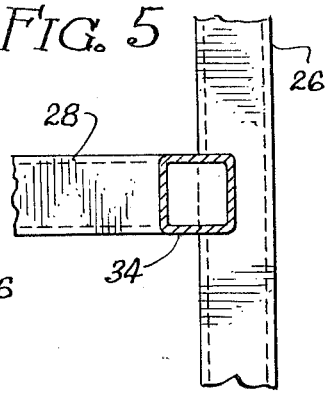
FIG. 5 is a section taken along line 5—5.

The basic form of the pallet is shown at 20 wherein the upper and lower grid platforms are indicated at 22 and 24, respectively. These platforms are identical and in fact the top half of the skid is the mirror image of the bottom half. Each of the platforms is made of a continuous peripheral header beam 26 and a number of lateral stringers 28 which span between the longitudinal lengths of the header beams 26. The continuous peripheral beams and the stringers are both made of one inch (2.5 cm), tubular steel which is generally square in cross section, and all the individual lengths are welded into place to define an extremely rigid and rugged platform. The stringers 28, shown as four in number, could be provided in any number desired.

The primary support serving to maintain the upper platform spaced from the lower platform, comprises two longitudinally extended runners 30. These runners are also tubular steel, and in the preferred embodiment, comprise rectangular-in-cross section tubing 1 inch (2.5 cm) thick and 3 inches (7.5 cm) tall. These runner tubes 30 are welded into position and capped at the ends with V-shaped caps 32 which finish off the ends of the runners and also act as guides for the prongs of a fork-lift, these prongs passing immediately outside of the two runners 30 so that the runners themselves act as guides.

The utilization of tubular runners 30, welded into position between the two platforms, invests the unit with a great deal of strength, particularly against compression, but also against bending and twisting forces. To make the unit even stronger, a plurality of upright stanchions 34 are welded between respective portions of the peripheral beams 26. The stanchions define rectangles with the stringers and corresponding portions of the runners 30 and offer high resistance to bending of the edges of the pallet downward under laterally unbalanced loads.

Figure 6:
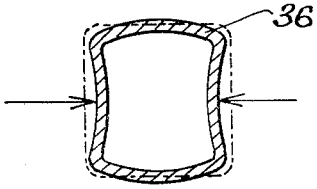
FIG. 6 is a section taken along line 6—6 of FIG. 1.

To further enhance the strength of the pallet, the corners of the header beams, indicated at 36, are arcuate in plan form and in cross section are passed between rollers to compress the sidewalls of the tube member defining these segments into a concave configuration shown in FIG. 6, with the concommitant bulging of the top and bottom surfaces of the tube into a convex configuration. This concave-convex combination results in the increased strength and ability to resist bending of these rounded corners.

Figure 9:
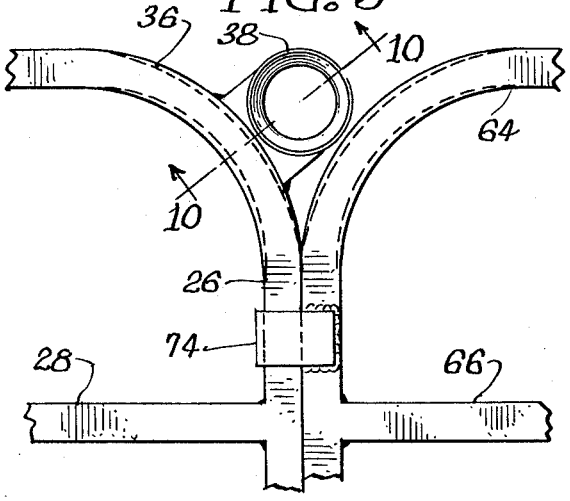
FIG. 9 is a top elevation view of a detail of the embodiment of FIG. 7.
Figure 10:
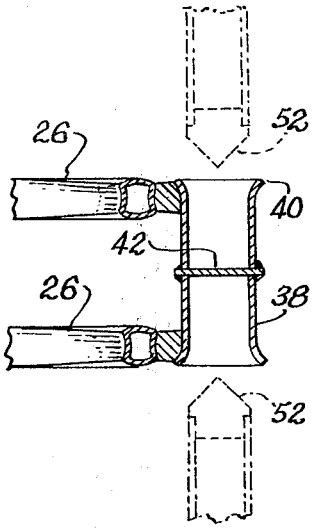
FIG. 10 is a section taken along line 10—10 of FIG. 9.
Figure 11:
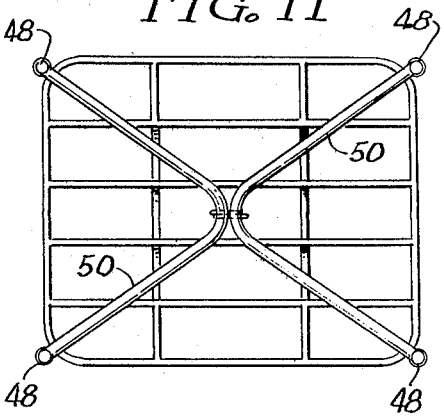
FIG. 11 is a top elevation view of a pallet with a stacking frame in place.
Figure 13:
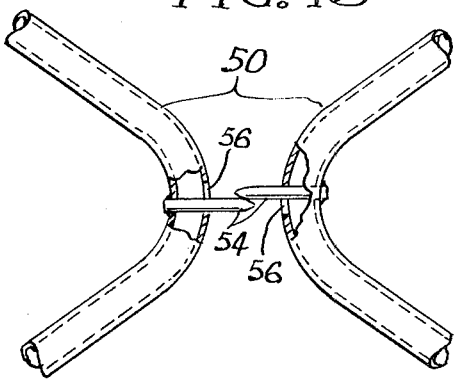
FIG. 13 is a detail of a stacking frame construction.
Figure 12:
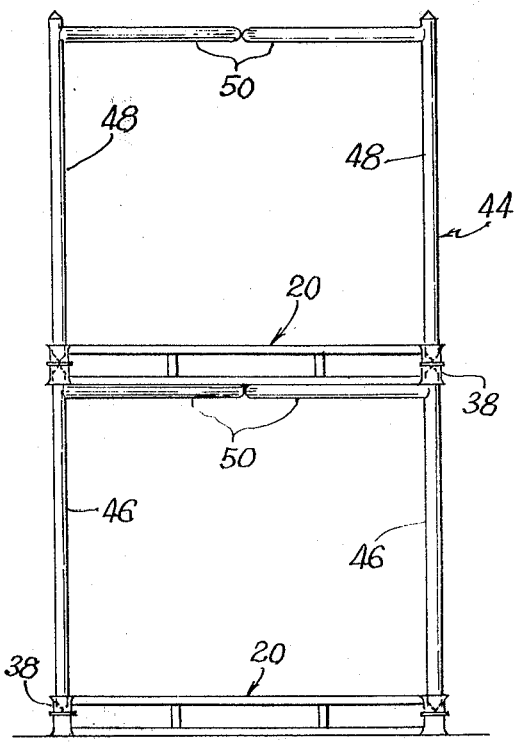
FIG. 12 is a side elevation view illustrating two stacked pallets with two stacking frames in place.

To maximize the utilization of floor space in warehouses having no shelves or racks, it is generally desirable to incorporate a stacking frame on top of each pallet so that two, three or possibly more pallets can be vertically stacked. To accommodate this need, in one embodiment of the pallet shown in FIG. 7, a double-ended socket 38 is welded to each of the corners 36, as best seen in FIGS. 9 and 10. These sockets have flared lips 40 and are actually made in two halves which are welded to a separator plate 42.

The frames which are engaged in these sockets are shown in FIGS. 11–16 at 44 and preferably comprise two identical components 46. Each of these components includes two upright posts 48 having generally V-shaped connectors 50 which have mutually embracing means at the center of the V. The posts themselves are preferably tapered at the bottom and the top by virtue of beveled plugs 52 and this taper, coupled with the approximately 2" diameter of the flares 40 of the sockets conform to the standard of pallet positioning accuracy by fork-lift which is 2". Note that the upper ends of these posts 48 are free to pass into the bottom of the sockets 38 permitting the full load of the upper pallet to be directly passed down vertically to the underlying supporting member. This contrasts with present stacking frames in which the connectors 50 are ordinarily used to bear the full weight of the overlying pallets.

The means joining the two components 46 of the stacking frames may be a pair of pins 54 which seat in sockets 56 alongside the pins. Note that with the pin on the left and the sockets immediately to the right, the components can be identically made and still mate properly.

Figure 14:
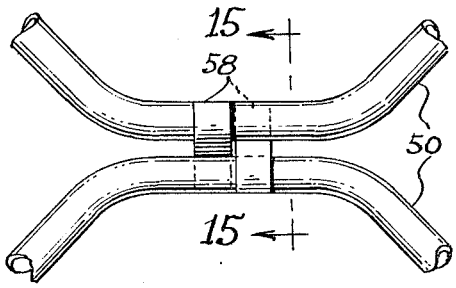
FIG. 14 is a detail of a modification of the stacking frame construction.
Figure 15:
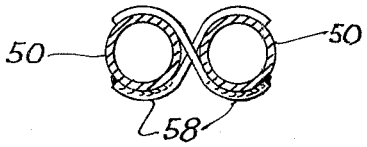
FIG. 15 is a section taken along line 15—15 of FIG. 14.
Figure 16:
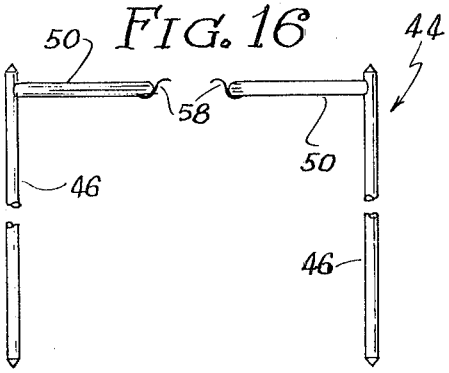
FIG. 16 is an exploded side elevation view of a pair of disengaged stacking frame components.

A variant means of embracing the two component parts of the frame is shown in FIGS. 14 through 16 wherein a strap or hook 58 on each of the V-shaped components engages over the top of the other, so that the two components must be coupled in an angular or twisting fashion but are then inseparable when the posts are engaged in the sockets and cannot be separated until they are removed, providing an added degree of stability and security to the unit.

Pallets are often transported within warehouses and elsewhere on conveyor belts made of parallel rollers. Transporting the instant pallet on such a roller would cause problems due to the spaced lateral stringers which would repeatedly hang up between rollers. To avoid this problem, longitudinal filler members 60 are welded flush with the outer surface defined by the platforms between tubing segments at the leading and trailing edge of the pallet.

Figure 7:
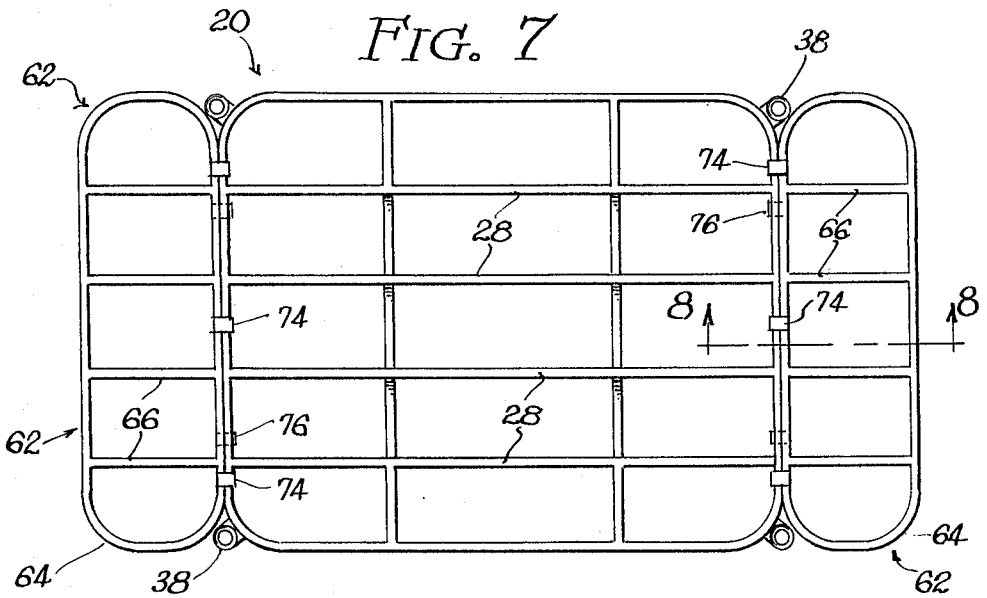
FIG. 7 is a top elevation view of a modification of the pallet and cooperating corner sockets and lateral extensions.
Figure 8:
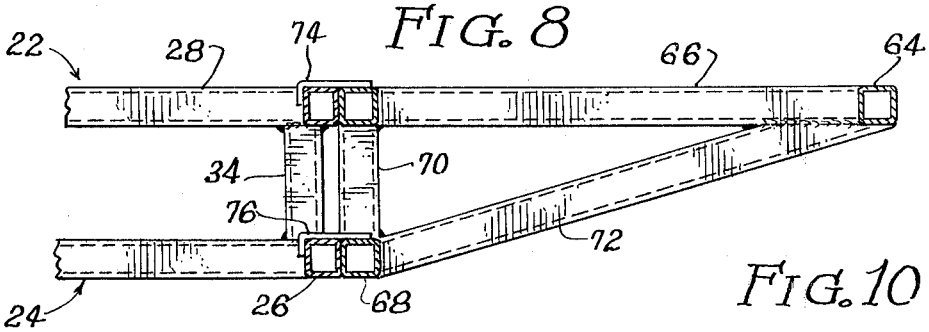
FIG. 8 is a section taken along line 8—8 of FIG. 7.

In the event that it is desired to make the pallets wider, pallet extensions are shown at 62 in FIGS. 7 and 8. Construction of the extensions is similar to that of the rest of the pallet and comprises oval tubes 64 and stringer extensions 66. A lower longitudinal member 68 lies flush against the lower platform 24 and connects to the oval beam 64 through a pair of stanchions 70 and angular supports 72. Three upper clamps 74 and two lower clamps 76 hold the extensions temporarily but firmly in place on one or both sides of the basic pallet as shown in FIG. 7.

The unit as shown in its several modifications and with its several component parts represents an advance in the pallet art, principally in the strength and durability of its construction, its elimination of the midline breaking problem, and the provision of runners which are two in number, rather than three, to correspond and act as guides for the prongs of a fork-lift. Additionally, this basic structure accommodates and is complemented by the strong and efficient stacking frames 44 and the lateral extensions 62 to define a simple but amazingly versatile improvement in the pallet art.

What is claimed is:

1. A warehouse pallet comprising:

first tubular steel members comprising an upper grid platform including:

a tubular steel perimeter of generally rectangular cross section and including a first pair of straight sections defining sides of a rectangular outline and a second pair of straight sections defining ends of the rectangular outline, and tubular steel stringers of generally rectangular cross section extending parallel to the first pair of straight sections of the perimeter and each welded to each of the second pair of straight sections, one surface of the perimeter and one surface of each of the stringers defining an upwardly facing upper plane;

a lower grid platform comprising a plurality of second tubular steel members of generally rectangular cross section and defining a downwardly facing lower plane parallel to the upper plane, at least spaced-apart areas of the second tubular members of the lower grid platform being aligned with and directly below areas of the first tubular members; and a plurality of support members located between juxtaposed surfaces of the steel members of both of the platforms to hold the platforms in rigidly spaced relation, the support members including:

tubular steel spacer stanchions of generally rectangular cross section extending perpendicularly to the planes of the platforms in line between and welded to the spaced-apart areas of the second tubular steel members and the areas of the first tubular steel aligned therewith, and additional tubular steel members of rectangular cross section welded to interior regions of the upper platform and to interior regions of the lower platform directly therebelow, the additional steel members and at least predetermined ones of the stanchions defining passageways below the upper grid platform to receive the prongs of a fork-lift to engage the upper grid platform transversely to the longitudinal direction of the stringers.

2. The invention as defined in claim 1 in which the lower grid platform is substantially identical to the upper grid platform.

3. The invention as defined in claim 1 in which the additional tubular steel members welded to interior regions of the upper and lower platforms comprise runners extending parallel to the other pair of the sections of the perimeter of the upper grid platform.

4. The invention as defined in claim 3 in which there are two such runners spaced apart parallel to each other less than the distance between the prongs of a fork-lift to guide the prongs.

5. The invention as defined in claim 1 in which the perimeter has four curved corners joined together into the rectangular outline by the straight sections.

6. The invention as defined in claim 1 comprising an upwardly directed side member comprising a respective socket mounted at each corner to engage and support a respective one of the four upright posts of a pallet-stacking frame.

7. The invention as defined in claim 6 wherein the sockets are flared and the bottoms of said posts are tapered to facilitate mating each post to its respective socket when stacking pallets.

8. The invention as defined in claim 6 comprising a pallet-stacking frame comprising two identical pairs of upright posts, each pair of posts engageable in a pair of the sockets and having an upper connector extending from the respective post pair with means for positively embracing the upper connector of the other post pair.

9. The invention according to claim 8 wherein each of the sockets defines upwardly and downwardly directed socket elements and the stacking frame posts each defines an upright upper end to engage the downwardly directed socket of an overlying pallet for positive stacking engagement of successive pallets.

10. The invention according to claim 9 wherein each of said upper connectors comprises a generally V-shaped brace linking the respective posts and an arcuate hook extending from generally centrally of the respective brace to engage over the other the braces.

11. The invention according to claim 8 wherein the means for positively embracing each upper connector comprises a pin engageable in a socket defined in the embraced connector.

12. The invention according to claim 1 including a pallet extension having means to engage the upper and lower platforms to define, when engaged, a projected continuation of the upper surface of the upper platform.

13. The invention according to claim 12 wherein the upper and lower platforms each have a continuous peripheral header beam and said means to engage comprise a pair of beams to lie substantially flush against the header beams and a plurality of hooks to hook over the latter.

* * * * *